US005772942A

United States Patent [19]

Teramoto et al.

[11] Patent Number: 5,772,942

[45] Date of Patent: Jun. 30, 1998

[54] PROCESSES FOR PRODUCING POLYBENZAZOLE FIBERS

[75] Inventors: Yoshihiko Teramoto; Tooru Kitagawa; Michio Ishitobi, all of Otsu, Japan

[73] Assignee: Toyo Boseki Kabushiki Kaisha, Osaka-Fu, Japan

[21] Appl. No.: 707,546

[22] Filed: Sep. 5, 1996

[30] Foreign Application Priority Data

Sep. 5, 1995 [JP] Japan ..... 7-228009
Sep. 13, 1995 [JP] Japan ..... 7-235208

[51] Int. Cl.[6] ..... D01D 5/06; D01D 10/02; D01D 10/06; D01F 6/26

[52] U.S. Cl. ..... 264/184; 264/211.15; 264/211.16; 264/211.17; 264/233

[58] Field of Search ..... 264/184, 211.15, 264/211.16, 211.17, 233, 234, 345

[56] References Cited

U.S. PATENT DOCUMENTS

| | | | |
|---|---|---|---|
| 5,019,316 | 5/1991 | Ueda et al. | 264/178 F |
| 5,273,703 | 12/1993 | Alexander et al. | 264/184 |
| 5,296,185 | 3/1994 | Chau et al. | 264/184 X |
| 5,429,787 | 7/1995 | Im et al. | 264/344 |

FOREIGN PATENT DOCUMENTS

| | | |
|---|---|---|
| 51-35716 | 3/1976 | Japan . |
| 63-12710 | 1/1988 | Japan . |

OTHER PUBLICATIONS

Abstract of Japan 7–197,307 (Published Aug. 1, 1995).

*Primary Examiner*—Leo B. Tentoni
*Attorney, Agent, or Firm*—Morrison & Foerster LLP

[57] ABSTRACT

The present invention provides processes for producing polybenzazole fibers where a spinning dope containing a polybenzazole polymer in an acid solvent is extruded through a spinning nozzle, followed by coagulation in a coagulating medium and washing with a fluid capable of dissolving the acid solvent; thereafter, in one process, the fiber obtained by the coagulation under specific conditions and the subsequent washing is dried in a heating zone with at least 80% part based on the total length thereof being set at a temperature of 240° C. or higher, and in the other process, the fiber obtained by the coagulation under the conventional conditions and the subsequent washing is neutralized with a basic solution, followed by washing with a fluid capable of dissolving the basic solution, and then dried at a specific temperature set depending upon the residual moisture content in the fiber. The present invention further provides a polybenzazole intermediate predried fiber having a residual moisture content of about 25% and exhibiting a single peak for liquid freezing in the fiber over a temperature range of from 20° to −70° C. when measured by differential scanning calorimetry (DSC).

9 Claims, 2 Drawing Sheets

PROCESSES FOR PRODUCING POLYBENZAZOLE FIBERS

FIELD OF THE INVENTION

The present invention relates to processes for producing polybenzazole fibers with high tenacity and high modulus of elasticity, and more particularly, it relates to processes for producing such high-performance polybenzazole fibers at a low cost on an industrial scale with a compact equipment by high-speed drying for a very short period of time. The present invention further relates to polybenzazole intermediate predried fibers, which are useful for these production processes where the drying step is not in line with the spinning, washing, and other steps.

BACKGROUND OF THE INVENTION

Polybenzazole fibers have a tenacity and a modulus of elasticity, both of which are at least two times greater than those of poly-para-phenylene terephthalamide fibers that are representative of the super fibers commercially available at present; therefore, they are expected as the super fibers of the coming future. It is well known in the art that polybenzazole fibers can be produced from a solution containing a polybenzazole polymer in polyphosphoric acid. For example, there have been made some proposals for the spinning method (see, e.g., U.S. Pat. No. 5,296,185 and U.S. Pat. No. 5,294,390); the drying method (see, e.g., Japanese Patent Application No. 5-304111/1993); and the method of heat treatment (see, e.g., U.S. Pat. No. 5,288,445).

Among the polybenzazole polymers are lyotropic liquid crystal polymers such as polybenzoxazole polymers and polybenzothiazole polymers, both of which exhibit no thermoplasticity. These polymers are, therefore, formed into fibers by the dry jet wet spinning method. More particularly, a spinning dope containing a polybenzazole polymer in an acid solvent is extruded through a spinning nozzle, followed by drafting in an air gap, and the extruded dope filament is then coagulated by bringing it into contact with a non-solvent for the polymer, followed by solvent dilution, desolvation, and drying.

For an improvement in the productivity, it is preferred that many fibers can be dried at a high speed for a short period of time. The polybenzazole fibers after the desolvation, however, contain a great amount of the non-solvent in 25% by weight or more, and they will exhibit a volume change on drying. In the short-tis=rapid drying of polybenzazole fibers, if these fibers are allowed to pass through a heating zone without any treatment. many defects will occur in the fibers during the drying. The defects are responsible for the decreased tenacity of the fibers, which are, therefore, not preferred. The occurrence of defects can be prevented by lowering the temperature of a heating zone; however, such low-temperature drying has a problem on the productivity because it requires a very long time.

As the conventional method to overcome this problem, there is, for example, a rapid drying method disclosed in the Japanese Patent Application No. 5-304111/1993. In this method, a polybenzazole fiber containing a non-solvent in 25% by weight or more is dried at 170° C. for 84.3 seconds, at 200° C. for 84.3 seconds, and then at 240° C. for 79.3 seconds, so that the residual moisture content is reduced to 1.5% by weight without giving any defects and the drying time is shortened to about 4 minutes.

It cannot, however, be said that the drying time is short enough to improve the productivity. For further shortening of the drying time, it is necessary to increase the diffusion coefficient of a non-solvent within the polybenzazole fibers. The test of various methods for this purpose revealed that the drying temperature is the most effective factor. In other words, the drying tune cannot be fully shortened at the drying temperature used in the conventional drying method. T high-speed drying method should, therefore, be developed by elevating the upper limit of drying temperature without giving any defects.

The greatest problem in the conventional production of polybenzazole fibers on an industrial scale is the large size of a high-speed fiber-making equipment because it requires a long time in the drying step as described above. Accordingly, there has been a demand for developing a high-speed method for drying polybenzazole fibers at elevated temperatures without giving any defects, which leads to a novel process for high-speed production of polybenzazole fibers on an industrial scale.

SUMMARY OF THE INVENTION

Under these circumstances, the present inventors have intensively studied to develop a high-speed method for drying polybenzazole fibers at clevated temperatures without giving any defects.

As a result, they have found that the fine structure of undried polybenzazole fibers and hence the drying phenomenon in the fibers can be controlled by the coagulating conditions, particularly temperature and concentration of a coagulating medium. Furthermore, the control of the coagulating conditions makes the polybenzazole fibers free from the occurrence of internal strain in the drying step, and even if the drying is interrupted at which time the fibers are dried only in the surface portion but contain a great amount of water in the core portion, the level of residual stress within the fibers is low and the subsequent reduction of a residual moisture content in the fibers causes no decrease in tenacity. These fibers exhibit no change in quality, even in the production process where the drying step is not in line with the spinning, washing, and other steps, resulting in that the rate of production can be made different between the former steps and the latter steps. They have further found that the upper limit of drying temperature without giving any defects can be elevated by neutralizing the fibers with a basic solution, even if the conventional coagulating conditions are used.

Thus the present invention provides two types of processes for producing a polybenzazole fiber.

The first production process comprises the steps of: extruding a spinning dope containing a polybenzazole polymer in an acid solvent through a spinning nozzle to form a dope ant; coagulating the dope filament as a fiber in a coagulating medium; washing the fiber with a fluid capable of dissolving the acid solvent. and drying the fiber in a heating zone with at least 80% part based on the tot length thereof being set at 240° C. or higher.

The second production process comprises the steps: extruding a spinning dope containing a polybenzazole polymer in an acid solvent through a spinning nozzle to form a dope filament;, coagulating the dope filament as a fiber in a coagulating medium; washing the fiber with a fluid capable of dissolving the acid solvent; bringing the fiber into contact with a basic solution for neutralization; washing the fiber with a fluid capable of dissolving the basic solution; and drying the fiber at a temperature set depending upon the residual moisture content in the fiber.

The present invention further provides a polybenzazole intermediate predried fiber having a residual moisture content of about 25% and exhibiting a single peak for liquid freezing in the fiber over a temperature range of from 20° C. to−70° C. when measured by differential scanning calorimetry (DSC).

DETAILED DESCRIPTION OF THE INVENTION

Figure 1:
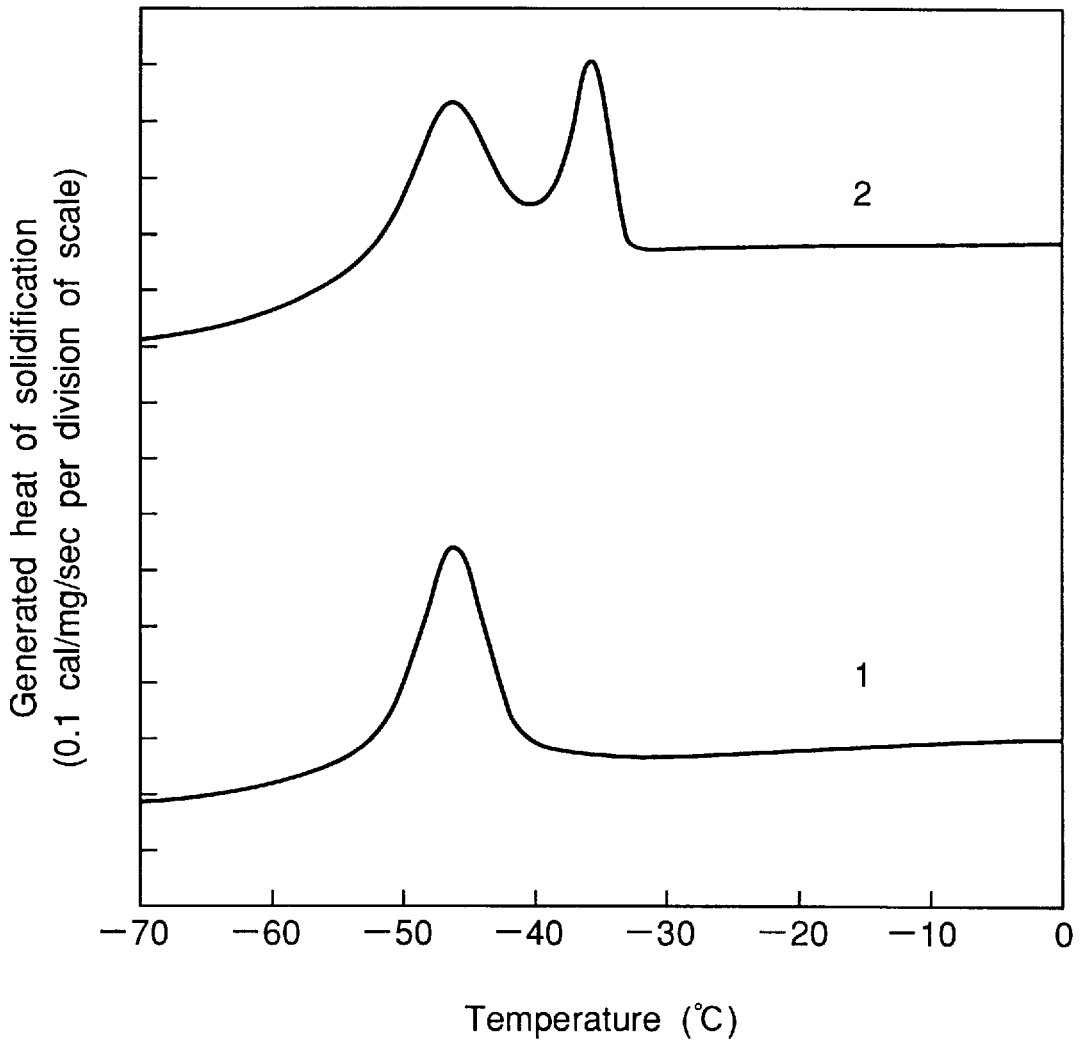
FIG. 1 shows two curves obtained by the differential scanning calorimetry of a polybenzazole intermediatepredried fiber of the present invention (curve 1) and of a conventional polybenzazole intermediate predried fiber (curve 2).

In the presses for producing polybenzazole fibers according to the present invention, a spinning dope containing a polybenzazole polymer in an acid solvent is extruded through a spinning nozzle, followed by coagulation in a coagulating medium and washing with a fluid capable of dissolving the acid solvent; thereafter, in the first process, the fiber obtained by the coagulation under specific conditions and the subse- quent washing is dried in a heating zone with at least 80% part based on the total length thereof being set at a temperature of 240° C. or higher, and in the second process, the fiber obtained by the coagulation under the conventional conditions and the subsequent washing is neutralized with a basic solution, followed by washing with a fluid capable of dissolving the basic solution, and then dried at a specific temperature set depending upon the residual moisture content in the fiber.

Preparation of Spinning Dope

In both production processes of the present invention, a spinning dope can be prepared by dissolving a polybenzazole polymer in an acid solvent.

The term "polybenzazole fiber(s)" as used herein refers to various fibers made of a polybenzazole (PBZ) polymer selected from the group consisting of polybenzoxazole (PBO) homopolymers, polybenzothiazole (PBT) homopolymers, and random, sequential or block copolymers of polybenzoxazole and polybenzothiazole. The polybenzoxazole, polybenzothiazole, and random, sequential or block copolymers thereof are disclosed in, for example, Wolfe et al., "Liquid Crystalline Polymer Compositions, Process and Products", U.S. Pat. No. 4,703,103 (Oct. 27, 1987), "Liquid Crystalline Polymer Compositions, Process and Products", U.S. Pat. No. 4,533,692 (Aug. 6, 1985), "Liquid Crystalline Poly-(2,6-Benzothiazole) Compositions, Process and Products", U.S. Pat. No. 4,533,724 (Aug. 6, 1985), "Liquid Crystalline Polymer Compositions, Process and Products", U.S. Pat. No. 4,533,693 (Aug. 6, 1985); Evers, "Thermooxidatively Stable Articulated p-Benzobisoxazole and p-Benzobisthiazole Polymers", U.S. Pat. No. 4,539,567 (Nov. 16, 1982); and Tsai et al., "Method for Making Heterocyclic Block Copolymer", U.S. Pat. No. 4,578,432 (Mar. 25, 1986).

The structural unit contained in the PBZ polymer is preferably selected from lyotropic liquid crystal polymers. Examples of the monomer unit for these polymers are depicted by the following structural formulas (a) to (h). It is preferred that the PBZ polymer is substantially composed of at least one monomer unit with a structure selected from these structural formulas (a) to (h), more preferably (a) to (c):

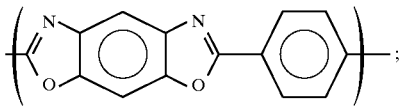
(a)

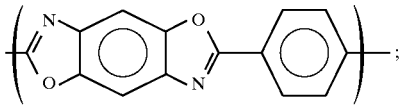
(b)

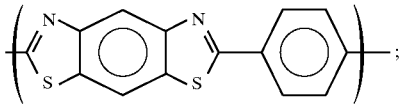
(c)

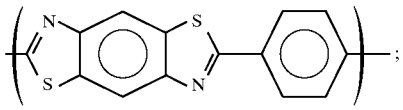
(d)

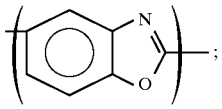
(e)

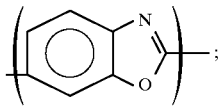
(f)

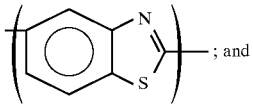
; and (g)

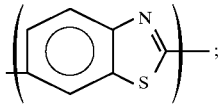
(h)

The acid solvent to prepare a spinning dope of a PBZ polymer include cresol or non-oxidative acids capable of dissolving the polymer, preferably polyphosphoric acid, methanesulfonic acid, high-concentrated sulfuric acid, and mixtures thereof, more prefer- ably polyphosphoric acid and methanesulfonic acid, and most preferably polyphosphoric acid.

The concentration of a PBZ polymer in the spinning dope is preferably at least about 7% by weight, more preferably at least 10% by weight, and most preferably at least 14% by weight. The maximum concentration is limited by actual handling properties such as solubility of the polymer and viscosity of the spinning dope. Because of these limiting factors, the polymer concentration is usually not greater than 20% by weight.

The preferred PBZ polymer or its spinning dope can be prepared by any conventional method, for example, as disclosed in U.S. Pat. No. 4,533,693 to Wolfe et al. (Aug. 6, 1985), U.S. Pat. No. 4,772,678 to Sybert et al. (Sep. 20, 1988), and U.S. Pat. No. 4.847,350 to Harris et al. (Jul. 11, 1989). According to the disclosure of U.S. Pat. No. 5,089,591 to Gregory et al. (Feb. 18, 1992), the molecular weight of a PBZ polymer can be increased at a high reaction rate under relatively high and high shearing conditions in a dehydrating acid solvent.

Production of Polybenzazole Fibers by the First Production Process

A spinning dope prepared as described above is supplied to a spinning apparatus and extruded through a spinning nozzle usually at a temperature of 100° C. or higher. The orifices of the spinning nozzle are usually arranged in the form of concentric circles or a grid, but they may be arranged in any other form. The number of orifices is not particularly limited, but the arrangement of orifices on the surface of the spinning nozzle should give an orifice density that causes no welding between the dope filaments extruded. In addition, when spinning is carried out at high speed, it is necessary to control the arrangement of orifices and the cooling gas flow so that the cooling gas temperature can be optimized between the dope filaments.

The dope filaments thus extruded through the spinning nozzle into a non-coagulating gas (i.e., what is called an air gap) is drafted in the air gap. It is particularly effective for stable production at high spinning rate that a quenching chamber for cooling the dope filaments with a cooling air is provided in the air gap to increase the cooling efficiency. The temperature of the cooling air, although it may vary with the molecular weight and concentration of the polymer, is preferably from about 10° C. to 120° C.

The dope filaments are then immersed in a coagulating medium for coagulation and/or extraction. The coagulating conditions have a quite important meaning on the achievement of a high-speed drying method as involved in the first production process. From a practical point of view, the coagulating medium is preferably an aqueous solution of phosphoric acid, which is an aqueous solution of the dope solvent.

The coagulating conditions include the temperature and concentration of a coagulating medium, coagulating time, tension applied to the dope filaments during the coagulation. and temperature and degree of orientation of the dope filaments introduced into the coagulating medium. Among these conditions, the temperature and concentration of a coagulating medium as well as the coagulating time arc particularly important with the temperature of a coagulating medium being most important.

The temperature of a coagulating medium is preferably from 30° C. to 120° C., more preferably from 35° C. to 85° C. When the coagulating medium is at a temperature of lower than 30° C., coagulating force is not sufficient, so that the phase separation tissue in the inner layer of a fiber becomes coarse and internal strain is, therefore, liable to occur during the drying. If the temperature is greater than 120° C., the dope filaments become too soft, so that the filament path cannot be stabilized unless stretch is kept being given to the filaments.

The concentration of a coagulating medium is preferably from 6% to less than about 50%, more preferably from 10% to 45%, and still more preferably from 15% to 35%. The concentrations of less than 6% are not preferred from an industrial point of view, because the decreased concentration of a coagulating medium gives sufficient coagulating force but it causes the problem of how a great amount of low-concentration coagulating medium (e.g., aqueous phosphoric acid solutions) is treated at a low cost to keep the concentration at a low level. The coagulation with a high-concentration coagu- lating medium is not preferred, because coagulating force is not sufficient similarly to the coagulation at low temperatures, so that the phase separation tissue in the inner layer of a fiber becomes coarse and internal strain is, therefore, liable to occur during the drying.

The coagulating time may vary with the temperature and concentration of a coagulating medium. That is, it requires a longer time under weak coagulating force (i.e., low temperature and high concentration) as compared with under strong coagulating force (i.e., high temperature and low concentration). The coagulating time, although it should be made shorter from the viewpoint of a size reduction of the equipment, is usually from 0.01 to 10 seconds, preferably from 0.05 to 5 seconds, and more preferably from 0.1 to 3 seconds.

The fibers coagulated under these conditions are then washed with a fluid capable of dissolving the acid solvent. After the washing, the fibers may have a fine structure suitable for drying for a short period of time. The conditions of such a washing step after the coagulation are not responsible for the significant structural change; however, if an aqueous phosphoric acid solution is used as the coagulating medium, the residual phosphorous concentration in the fibers is preferably 10,000 ppm or lower, more preferably 7000 ppm or lower.

Moreover, a neutralizing step may or may not be carried out concurrently with or separately from the washing step. As an agent used in the neutralizing step, various bases of alkali metals can be used. The ratio of alkali metal atoms to phosphorous atoms in the residual solvent within the fibers may be set at from 0.2 to 1.8, which is not essential but preferred for keeping the physical properties of the fibers during the post- fabrication.

The undried polybenzazole fibers thus obtained (i.e., intermediate predried fibers) show a small difference in higher order structure between the core portion and the surface portion. The higher order structure as used herein can be evaluated by the size distribution of fine voids having a size of several tens angstrom in the fibers. The size distribution can be determined by any of the methods in which an undried fiber is immersed in an aqueous solution containing heavy metal ions and the localized heavy metal ions in water within the voids are observed by transmission electron microscope or in which an undried fiber is cooled in the differential scanning calorimeter to measure the temperature at which water in the fiber is frozen. The latter is more convenient, but it requires the separation of water contained in the fiber from water attached to the fiber surface. This is achieved by predrying the fiber at 180° C. under a tension of 2 g/d until the residual moisture content in the fiber is reduced to about 25%, so that water on the fiber surface and in the surface portion of the fiber is partially removed.

The residual moisture content in the fiber as used herein is defined as a percentage by weight of water contained in the fiber to the absolute dry weight of the fiber. The residual moisture content can be adjusted to 25% by changing the residence time in the drying devise. The reason why the tension is set at 2 g/d in this case is that high tension in the predrying makes a change in the void size with a progress of fiber orientation and such a change should be prevented. The reason why the predrying temperature is set at 180° C. is that the rate of weight reduction is appropriate and the residual moisture content in the fiber can readily he adjusted.

In general, the freezing point of water confined in the pore is decreased as the thermodynamic action by its surface tension. As reported by lshikiriyama et al., Polymer Preprints, Japan, Vol. 34, No. 9, p. 2645 (1985), it is well known that a decrease in freezing point will suddenly occur when the pore size becomes 100 angstrom or less. The comparison of DSC curves of water contained in the polybenzazole predried fiber makes it possible to evaluate the size and distribution of voids in the fiber. The results of differential scanning calorimetry over a temperature range of from 20° to−70° C. for the samples prepared as described above reveal that the polybenzazole intermediate predried fiber of the present invention exhibits a single peak as shown by curve 2 in FIG. 1, whereas the conventional intermediate predried fiber not included in the scope of the present invention, for example, prepared at a coagulating temperature of 25° C. with a coagulating medium having a phosphoric acid concentration of 22%, exhibits two peaks as shown by curve 1 in FIG. 1. The fiber exhibiting two peaks has an ununiform internal structure, and the occurrence of voids responsible for tenacity decrease will be caused in the drying step at about 240° C. or higher temperatures. The upper limit of drying temperature without giving any voids in the fibers is about 240° C. or higher for the fiber exhibiting substantially a single peak but about 230° C. or lower for the fiber exhibiting substantially no single peak.

The drying time for polybenzazole fibers can be reduced more and more with a rise in the drying temperature. This is because the velocity of movement of water molecules in the fiber as a cluster or a monomolecular gas is in proportion to the half power of an absolute temperature. In the prior art, however, if the fiber having a residual moisture content of 15% or more is dried at the initial drying temperature of as high as 240° C., there will occur many voids in the fiber, which causes some problems such as tenacity decrease and increased photo-oxidative deterioration.

As described above, the present inventors have found that even if undried fibers with a uniform void size are dried at 240° C. or higher temperatures, no tenacity decrease is caused. The temperature which can be used in the drying step may vary with the structure formed by coagulation. Even if undried fibers which have been coagulated in an ideal manner are dried at 300° C. or higher, there is neither tenacity decrease nor void occurrence. With the condition that the coagulating temperature is about 30° C. or higher, it makes possible that no tenacity decrease is caused even by high-temperature drying at 240° C. or higher.

The structural change of fibers, causing such a phenomenon, is evidenced as follows. The stain of molecules in the drying step can be measured by Raman spectroscopy. A method for measuring the strain of molecules by the shift of absorption peaks over a wave-number range of from 1580 to 1640 $cm^1$ is described by Young et al. in Journal of Materials Science, 25, 127 (1990).

The present inventors have been used this method to evaluate the drying of a fiber on a hot stage at 240° C., which was prepared by spinning at a spinning rate of about 400 m/min and then keeping for 0.3 second in a coagulating medium having a phosphoric acid concentration of 22% at 20° C., followed by thorough water washing. They have found that strain for compression is applied to the molecular chain to form macroscopic voids, so that the strain is reduced and the shift of absorption peaks disappears. They have further found that when the coagulating conditions are controlled according to the present invention, no peak shift is observed during the drying on a hot stage at 240° C., and the degree of peak shift is 1 $cm^{-1}$ or less even at 280° C. In the meantime, the degree of peak shift can be measured by Raman spectroscopy with an argon laser light source, for example, using Ramanor-U1000 available from Jobin-Yvon, Co.

In the drying step, drying begins from the fiber surface portion. The volume change at this time causes the occurrence of internal strain; however, if the difference in contraction between the core portion and the surface portion of the fiber becomes small, the strain of a molecular chain is also reduced. Even if the fiber of the present invention is left to stand in the state that only the fiber surface portion has been dried, there is caused no occurrence of voids. In contrast, if the conventional fiber is left to stand in the state that it has large internal strain by partial drying. there will occur many voids when the residual moisture content in the fiber is reduced by evaporation, which leads to tenacity decrease. According to the present invention, it also makes possible that a fiber previous- ly wound up as a package after the interruption of drying is further dried later and also that drying is carried out in a short length for multi-suspension treatment at a decreased process speed.

The object of the present invention is to produce polybenzazole fibers at a low cost with a drying equipment made into a compact size. It is, therefore, preferred that the drying temperature is set as high as possible and also that as many sections in the drying step as possible are kept at high temperatures. In particular, when fibers are continuously dried with a plurality of drying devices, the joining area between the devices, at which the fiber temperature is deceased, should be made as short as possible. It is preferred that at least 80%, more preferably 95%, part of the drying zone based on the total length thereof is kept at 240° C. or higher. The drying temperature, although it should be change with the structure of an undried fiber, is about 240° C. or higher, more preferably 260° C. or higher, and most preferably 280° C. or higher. The upper limit of drying temperature is preferably 290° C. or lower, so long as the fiber bundling and static eliminating properties are achieved with a lubricant. Even when the fiber bundling properties can be attained by the charge control method or the like, the upper limit of drying temperature should be about 650° C. or lower in view of the heat-resisting properties of the PBZ polymer.

The drying time is preferably about 80 seconds or shorter, more preferably about 60 seconds or shorter, and most preferably about 30 seconds or shorter, for drying to the extent of giving not higher than about 2% of the equilibrium residual moisture content in the fiber, in view of the equipment cost.

As the heating zone in the drying step, there can be used radiant heaters such as electric ovens or flame; heat transfer means such as heating rollers; or heating media such as heated inert gases, overheated water vapor or heated oils. Furthermore, electro magnetic waves such as microwaves, or shock waves, may be used together for fibers kept at high temperatures. These heating means may be used in combination. In any case, it is most important that fibers can rapidly be heated.

The drying step is preferably carried out under on-line control from the washing step. More preferably, after drying to the extent of giving the equilibrium or lower residual moisture content, the dried fibers are wound up into a product. In some cases, undried fibers may be predried to the extent of giving a residual moisture content which makes it possible to wind up the fibers in the drying step, followed by subsequent drying of the wound fiber package. Alternatively, the predried fibers may be released from the wound fiber package, followed by drying and heat treatment of the released fibers in a continuous manner. The residual moisture content which makes it possible to wind up the fibers is preferably about 25% or lower, more preferably about 15% or lower, and most preferably about 4% or lower.

Production of Polybenzazole Fibers by the Second Production Process

A spinning dope containing a polybenzazole polymer in an acid solvent is prepared as described above and spun by the conventional dry jet wet spinning method. More particularly, the spinning dope is extruded through a spinning nozzle, and the extruded dope filaments are allowed to pass through a gas and coagulated into fibers by bringing them into contact with a non-solvent for the polymer. that is. a thin solvent which cannot dissolve the polymer. The residual acid solvent in the fibers after the coagulation is washed with a fluid capable of dissolving the acid solvent. The fibers thus washed usually have a residual moisture content of from 25% to 200% by weight. The fluid used for washing, although it may be in the form of a gas such as water vapor, is preferably a liquid, and most preferably an aqueous solution. The fibers may be brought into contact with a washing liquid in a bath or by a spray.

As the washing liquid bath, various types of liquid baths can be used, such as disclosed in JP-A 63-12710/1988; JP-A 51-35716/1976; and JP-B 44-22204/1969. These liquid baths may be combined with a method in which a washing liquid is sprayed on the fibers running between two rollers, as disclosed in U.S. Pat. No. 5,034,250 to Guertin (Jul. 23, 1991). The washed fibers, which contain the non-solvent in about 30% by weight or more by interdiffusion with the acid solvent, are brought into contact with a basic solution for neutralization of the residual acid solvent in the fibers. without any treatment or after the removal of the non-soluble washing liquid attached to the fiber surface. The basic solution used for neutralization, although it may be in the form of a gas such as water vapor, is preferably a liquid having good handling properties, and more preferably an aqueous solution.

The term "basic solution" as used herein refers to, but not limited to, various solutions of a base (e.g., sodium hydroxide, calcium hydroxide, ammonia, sodium carbonate, calcium carbonate) dissolved in water or an organic solvent (e.g., methanol, ethanol, acetone) and having a certain hasicity. The concentration of a basic solution is preferably 0.001N or higher, more preferably 0.01N or higher, and still more preferably from 0.1N to 3.0N. The contact time is preferably 0 second or longer, more preferably 1 second or longer, and still more preferably from 3 to 120 seconds. The contact time can be made shorter to a constant time with an increase in the concentration of a basic solution.

The fibers may be brought into contact with a basic solution in a bath or by a spray. This may be combined with a method in which a basic solution is sprayed on the fibers running between two rollers. Although the fibers may be washed with a basic solution in the above coagulating or washing step, it is preferred from an economical point of view that the fibers are brought into contact with a basic solution at the stage that the concentration of the residual acid solvent in the fibers is as low as possible, thereby attaining the neutrali7ation of the residual acid solvent in the fibers.

The concentration of the residual acid solvent in the fibers after the neutraliza- tion is preferably 10,000 ppm or lower, more preferably 5000 ppm or lower. The molar ratio of base to acid in the fibers after the neutralization is at least 0.5, more preferably from 0.75 to 1.5, and most preferably from 1.0 to 1.3. If the molar ratio is not less than 1.0, it is considered that the residual acid solvent in the fibers is completely neutralized. For example, the ratio of phosphorous atoms to sodium atoms when sodium hydroxide is used can measured by an appropriate analytical apparatus such as fluorescence X-ray spectrometer.

Figure 2:
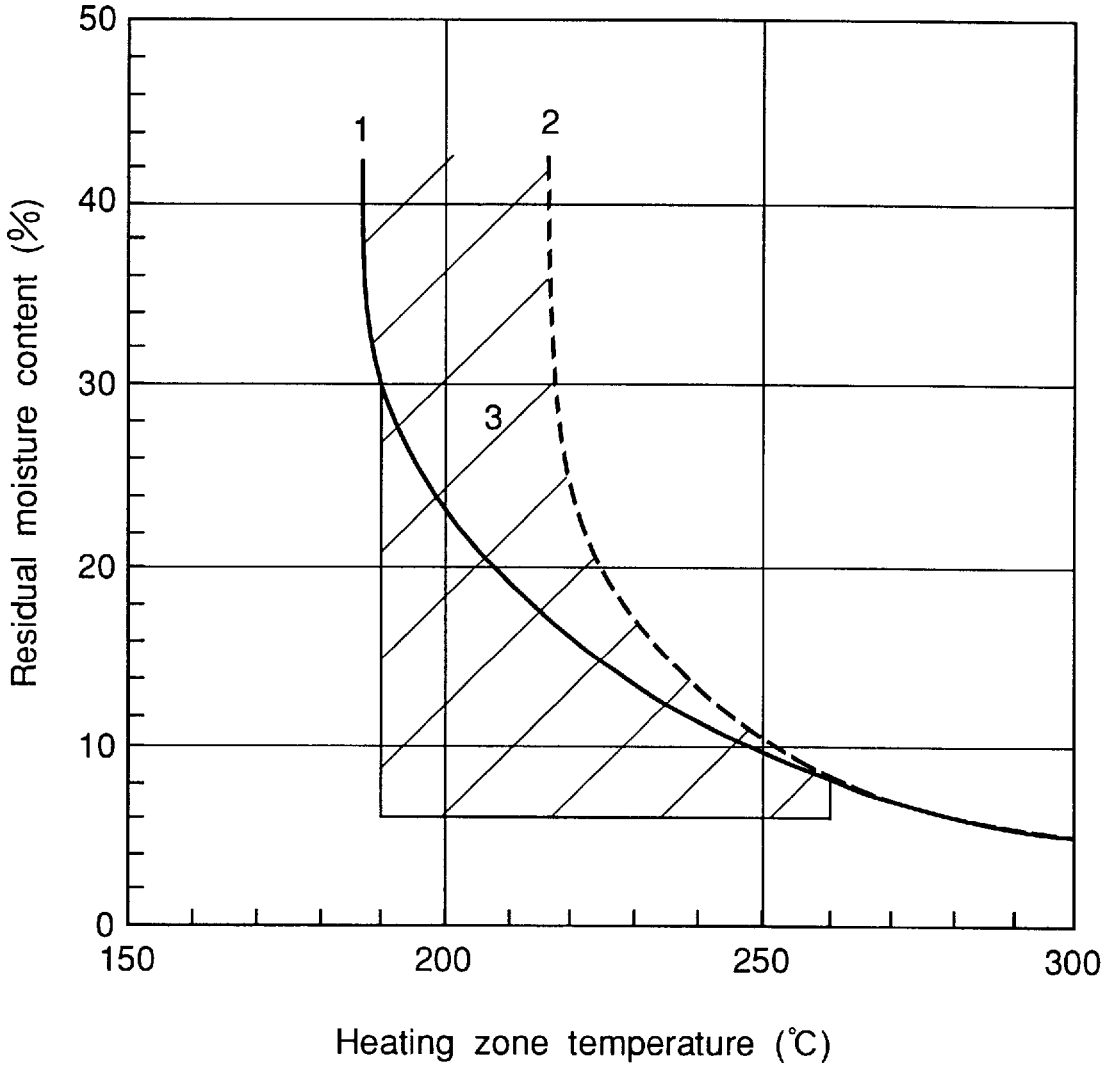
FIG. 2 shows the relationship between the residual moisture content and the drying temperature for polybenzazole fibers. The upper limit of drying temperature without giving any defects is plotted by curve 1 when the fiber is brought into contact with a basic solution and by curve 2 when the fiber is brought into no contact with a basic solution. The initial drying conditions used in the present invention is represented by hatched area 3.

The purposes of neutralization are (1) to prevent the catalytic action of the residual acid solvent in the fibers, which causes the hydrolysis of a polymer by heating or light irradiation in the drying or heat treatment step; and (2) to prevent the occurrence of voids by decreasing the surface tension of the residual washing liquid in the fibers. The maximum temperatures for drying without giving any defects in the fibers are shown in FIG. 2, as determined for the process of the present invention and the conventional process disclosed in Japanese Patent Application No. 5-304111/1993, based on the respective residual moisture contents. The changes in the properties of the residual non-solvent make it difficult to cause the occurrence of void defects responsible for fiber tenacity decrease as compared with the conventional process.

After brought into contact with the basic solution, the fibers are washed with a fluid capable of dissolving the basic solution to remove the basic solution. The fluid used for such washing, although it may be in the form of a gas such as water vapor, is preferably a liquid having good handling properties. The fluid used for washing the solvent is necessary to comply with the conditions that the solvent for the polymer can be freely dissolved in the fluid and that part of the fluid diffused into the fibers can be removed later. Preferred are aqueous solutions. The liquid used for washing preferably has an acidity of from about 6 to 11 in pH.

The fibers coagulated, washed, brought into contact with a basic solution, and washed again in the above-described manner usually contain the residual liquids in about 25% or more. These fibers are then allowed to pass through a heating zone for drying. As the heating zone, there can be used, for example, electric ovens, heating rollers, heated air, heated inert gases, shock wave, overheated water vapor, or heading media such as oils. Furthermore, electromagnetic waves such as microwaves may be used together for fibers kept at high temperatures. These heating means may be used in combination. In any case, it is most important that fibers can rapidly be heated.

In the drying step, the above residual liquids in the fibers are evaporated to the permissible residual moisture content of about 4% or less. This is because the contraction in the radial direction of the fibers after wound up into a package causes the occurrence of cheese-like pores and broken edges.

For example, when a two-stage heating zone is used, the fibers having a residual moisture content of about 38% by weight after the washing are dried at a of 220° C. or lower by the first-stage heating means to have a residual moisture content of 10% by weight and then dried at a temperature of 240° C. by the second-stage heating means to have a residual moisture content of 3% by wight, as shown in FIG. 2.

The time for drying without giving any defects in the fibers under the conditions within area 3 shown in FIG. 2 is preferably 3 minutes or shorter, more preferably 120 seconds or shorter, and most preferably 90 seconds or shorter, from an industrial point of view.

The atmosphere in the heating zone may be air or an inert gas such as helium or argon, which may contain carbon dioxide or any other gases at a high gas content. The atmosphere in the heating zone, although it is preferably used at the atmospheric pressure, may vary in pressure. The velocity of air or gas flow in the heating zone is preferably increased for enhancing the movement of substances from the fiber surface.

The average tensile strength of a fiber, which is defined as fiber breaking force per denier g/d), is preferably at least 7.3 g/d, more preferably at least 12.7 g/d, still preferably at least 20 g/d, still further preferably at least 29.8 g/d, and most preferably at least 45 g/d. The tensile strength of a fiber is decreased to the level of about 95% or lower as the retention of tenacity by the occurrence of many voids.

The average tensile modulus of elasticity of a fiber, which is defined as initial resistance to stretching per denier (g/d), is preferably al least 1100 g/d, and more preferably at least 1600 g/d. If necessary, the fiber may be subjected to heat treatment for increasing the tensile modulus of elasticity. An appropriate spinning lubricant is applied to the fiber, followed by winding up into a package. The heat treatment may be carried out under on-line or off-line control before or after the winding up, respectively.

The mechanism of an improvement in the resistance to void occurrence by contact with a basic solution, although it has not yet been completely understood, may be believed that the non-solvent trapped into the pores of about 30 angstrom or less in size within the fiber may be changed in the surface tension properties and the residual stress is decreased after the removal of the trapped non-solvent by drying. For this reason, the upper limit of drying temperature without giving any voids is shifted toward the high temperature side, as shown in FIG. 2, from the solid curve for the prior art to the dotted curve for the present invention. Even if the drying temperature is elevated, it is possible to obtain high quality polybenzazole fibers; therefore, the drying time can be shortened. The contact with a basic solution has an additional effect that the retention of tensile strength can be increased by the drying and heat treatment of fibers.

The present invention will be further illustrated by the following examples which are not to be construed to limit the scope thereof.

Measurements of Residual Moisture Content

The residual moisture content in a fiber can be measured as follows. About 1.0 g of the fiber is taken and precisely weighed ($W_1$). The fiber is dried with a stationary drying machine at 230° C. for 30 minutes, and then weighed again ($W_0$). The residual moisture content is calculated by the following equation:

$$\textit{Residual moisture content}\ (\%)=\{(W_1-W_0)/W_0\}\times 100$$

Differential Scanning Calorimetry

The differential scanning calorimetry was carried out with the differential scanning calorimeter DSC 3100S available from MacScience, Co. (hereinafter referred to as the DSC measurement). As the sample, a bundle of incompletely dried fibers was quickly cut into a length of from 1 to 5 mm, and from 2 to 12 mg of these fibers was weighed on a balance and encapsulated in an aluminum pan. At this time, the residual moisture content in the sample for measurement should be adjusted to about 25%. This is because if the DSC measurement is carried out for the sample containing a great amount of free water (i.e., water attached lo the outer surface of the fiber), the frizzing of such fee water becomes an obstructive factor for the measurement of the freezing point of water in the voids of interest. The peaks appearing over a temperature range of from 0. to 40° C. are particularly liable to be affected. The distribution of freezing points was determined by the measurement and evaluation of DSC curves in the course with a temperature drop. In principle, the same results should have been obtained from the measurement in the course with a temperature rise; however, such a measurement was not suitable for the practical evaluation because of dull peaks appearing on the DSC curves. The speed of temperature drop was set at 10° C./min and the measurement was carried out over a temperature range of from 20to−70° C. Examples of the DSC curve thus obtained are shown in FIG. 1. Based on the presence or absence of a peak split, the difference in the distribution of voids can be evaluated.

Observation of Defects

The amount and dispersed state of defects formed in the fiber were observed by placing a fiber strip cut into an about 4 cm length on a slide glass and using an optical microscope of 200 magnifications.

In the present invention, the defects are observed as black stripes (voids) along the fiber axis and distinguished from stripes (kinks) at an angle to the fiber axis.

The number of defects in 166 fibers at a length of 18 mm was counted with an optical microscope and classified into 6 ranks, i.e., none (0 defect), very slight (1 to 2 defects), very slight to slight (3 to 4 defects), slight (5 to 10 defects), slight to many (11 to 15 defects), and very many (16 or more defects).

The following Examples 1–10 and Comparative Examples 1–4 will illustrate the first process for producing polybenzazole fibers according to the present invention.

Examples 1–8 and Comparative Examples 1–2

A spinning dope was prepared from 140 wt % polybenzoxazole polymer with an intrinsic viscosity of 24.4 dl/g as measured in methanesulfonic acid at 30° C., which had been obtained by the method disclosed in U.S. Pat. No. 4,533,693, as well as polyphosphoric acid with a phosphorous pentoxide content of 83.17%. The spinning dope was filtered through a metal net and fed to a two-screw kneader for kneading and defoaming, followed by pressurizing and keeping the dope temperature at 175° C., which was extruded from a spinning nozzle with 334 orifices at 175° C. The extruded dope filament was cooled with a cooling air at 60° C. and then introduced into an aqueous phosphoric acid solution as a coagulating medium. The spinning rate as well as the temperature and concentration (phosphoric acid) of the coagulating medium are shown in Table 1 below. The spinning, coagulating, water washing (neutralizing by NaOH), and drying steps were carried out under on-line control. A hot-air drying oven (air velocity, 16 m/sec) was used as the drying device. The washing and drying conditions, together with the physical properties of the fiber, are also shown in Table 1 below.

TABLE 1

| | Ex. 1 | Comp. Ex. 1 | Ex. 2 | Ex. 3 | Ex. 4 | Ex. 5 | Comp. Ex. 2 | Ex. 6 | Ex. 7 | Ex. 8 |
|---|---|---|---|---|---|---|---|---|---|---|
| Spinning rate (m/min) | 400 | 400 | 400 | 400 | 400 | 400 | 400 | 600 | 800 | 200 |
| Temperature of coagulating medium (°C.) | 35 | 25 | 30 | 50 | 75 | 30 | 25 | 50 | 50 | 90 |
| Concentration of coagulating medium (%) | 22 | 22 | 22 | 22 | 45 | 2 | 2 | 22 | 22 | 22 |

TABLE 1-continued

| | Ex. 1 | Comp. Ex. 1 | Ex. 2 | Ex. 3 | Ex. 4 | Ex. 5 | Comp. Ex. 2 | Ex. 6 | Ex. 7 | Ex. 8 |
|---|---|---|---|---|---|---|---|---|---|---|
| Residence time in coagulating medium (sec) | 0.1 | 0.1 | 0.1 | 0.1 | 0.1 | 0.1 | 0.1 | 0.07 | 0.05 | 0.2 |
| Concentration of first washing medium (%) | 2.3 | 2.3 | 2.3 | 2.3 | 2.3 | 2.3 | 2.3 | 2.3 | 2.3 | 1.8 |
| Concentration of second washing medium (%) | 0.2 | 0.2 | 0.2 | 0.2 | 0.2 | 0.2 | 0.2 | 0.2 | 0.2 | 0.1 |
| Concentration of neutralizing medium (0.1N) | 0.4 | 0.4 | 0.4 | 0.4 | 0.4 | 0.4 | 0.4 | 0.4 | 0.4 | 0.4 |
| pH of third washing medium | 9.5 | 9.5 | 9.5 | 9.5 | 9.5 | 9.5 | 9.5 | 9.5 | 9.5 | 9.3 |
| Temperature of first drying oven (°C) | 240 | 220 | 250 | 290 | 250 | 250 | 230 | 270 | 260 | 240 |
| Residence time in first drying oven (sec) | 40 | 40 | 40 | 25 | 40 | 40 | 100 | 50 | 60 | 60 |
| Passing time through oven joining area (sec) | 0.06 | 0.06 | - | - | - | - | - | - | - | 0.12 |
| Temperature of second drying oven (°C) | 250 | 240 | - | - | - | - | - | - | - | 250 |
| Residence time in second drying oven (sec) | 30 | 80 | - | - | - | - | - | - | - | 45 |
| Total drying time (sec) | 70 | 120 | 40 | 25 | 40 | 40 | 40 | 50 | 60 | 105 |
| Residual moisture content (%) | 0.6 | 1.2 | 1.2 | 0.9 | 1.1 | 0.8 | 1.7 | 1.6 | 1.8 | 0.4 |
| Observation of voids with optical microscope | none | none | none | none | none | none | slight to many | none | none | none |
| Fineness (denier) | 497 | 497 | 497 | 497 | 498 | 496 | 497 | 499 | 498 | 496 |
| Tenacity (g/d) | 43 | 42 | 44 | 42 | 44 | 45 | 39 | 43 | 42 | 43 |
| Elongation (%) | 3.9 | 3.8 | 3.8 | 3.6 | 3.9 | 3.8 | 3.4 | 3.7 | 3.8 | 3.9 |
| Modulus of elasticity (g/d) | 1520 | 1510 | 1580 | 1600 | 1570 | 1590 | 1580 | 1560 | 1530 | 1490 |

As can be seen from Table 1, the polybenzoxazole fibers prepared under the coagulating conditions within the scope of the present invention exhibited no occurrence of voids and hence no deterioration of their physical properties, although they were dried for a very shorter period of time as compared with the conventional process.

Example 9 and Comparative Example 3

The undried polybenzoxazole fibers prepared by spinning, coagulating, and water washing (neutralizing) under the same conditions as used in Example 3 and Comparative Example 1 were predried at 180° C. under a tension of 2 g/d for 34 seconds so as to have a residual moisture content of 25%, thereby obtaining polybenzoxazole intermediate predried fibers of Example 9 and Comparative Example 3, respectively, which were then wound up and subjected to the DSC measurement. The results are shown in FIG. 1, where the DSC patterns of the intermediate predried fibers of Example 9 and Comparative Example 3 are represented by curves 1 and 2, respectively.

The intermediate predried fibers of Example 9 and Comparative Example 3 were then allowed to pass through a drying machine to examine the upper limit of drying temperature without giving any voids. The temperature at which voids started occurring was 295° C. and 225° C. for the intimidate predried fibers of Example 9 and Comparative Example 3, respectively.

Example 10 and Comparative Example 4

The undried polybenzoxazole fibers prepared by spinning, coagulating, and water washing (neutralizing) under the same conditions as used in Example 3 and Comparative Example 1 were allowed to pass through a drying machine at 220° C. for 80 seconds to give polybenzoxazole intermediate predried fibers of Example 10 and Comparative Example 4, respectively, which were then wound up. At this stage, the residual moisture content was 5.1% and 5.7% for the intermediate predried fibers of Example 10 and Comparative Example 4, respectively. These intermediate predried fibers were left to stand at a dark place in the room at an atmospheric temperature of 2()° C. and a relative humidity of 65% for 42 hours. After the natural drying, the residual moisture content was reduced to 1.9% and 2.1 % for the intermediate predried fibers of Example 10 and Comparative Example 4, respectively. The results of observation with an optical microscope and the physical properties, as well as the residual moisture content, before and after the natural drying are shown in Table 2 below.

TABLE 2

| Intermediate predried fibers (at 220° C. for 80 seconds) | | Example 10 | Comparative Example 4 |
|---|---|---|---|
| Before natural drying | Residual moisture content (%) | 5.1 | 5.7 |
| | Observation with optical microscope | no voids | no voids |
| | Fineness* (denier) | 498 | 498 |
| | Tenacity (g/d) | 44 | 44 |
| | Elongation (%) | 3.9 | 3.9 |
| | Modulus of elasticity (g/d) | 1490 | 1500 |
| After natural drying | Residual moisture content (%) | 1.9 | 2.1 |
| | Observation with optical microscope | no voids | voids |
| | Fineness* (denier) | 498 | 498 |
| | Tenacity (g/d) | 43 | 38 |
| | Elongation (%) | 3.8 | 3.4 |
| | Modulus of elasticity (g/d) | 1500 | 1520 |

*The values of fineness were calculated from the absolute dry weight.

As can be seen from Table 2, the polybenzazole intermediate predried fiber of the present invention has excellent characteristics such that the change in fiber quality is difficult to occur with natural drying.

The following Examples 11–15 and Comparative Examples 5–7 will illustrate the second process for producing polybenzazole fibers according to the present invention.

Example 11

A spinning dope was prepared by dissolving cis-polybenzoxazole polymer with an intrinsic viscosity of 30 dl/g at a ratio of 14% by weight into polyphosphoric acid and extruded from a spinning nozzle at 160° C. The extruded dope filament was then coagulated with ion-exchanged water at 22° C. under the phosphoric acid concentration of 21% and washed with water. In the subsequent neutralizing step, 0.1 N NaOH solution was used as a basic solution. After water washing and removal of water with an air knife, the filament was dried by allowing to pass between the first heating rollers at 220° C. for 60 seconds, between the second heating rollers at 225° C. so as to have a residual moisture content of 5.7%, and between the third heating rollers at 255° C. The drying conditions and the physical properties of the fiber are shown in Table 3 below.

As can be seen from Table 3, the conditions of drying temperature without giving any voids (i.e., residual moisture content before drying, 38%; and hearing zone temperature, 220° C.) as shown in FIG. 2 give no occurrence of voids. Furthermore, the drying time can be remarkably shortened as compared with the conventional typical value of about 4 minutes.

Comparative Example 5 and 6

The polybenzoxazole fibers were prepared and dried in the same manner as described in Example 11, except that these fibers were brought into no contact with a basic solution and the drying conditions were changed (Comparative Example 5) or not changed (Comparative Example 6). The physical properties of the fibers, together with the drying conditions, are shown in Table 3 below.

If no neutralization is carried out, the initial drying temperature is not higher than 190° C., which can be applied to the case where fibers with a residual moisture content of 38% after washing are to be dried without giving any voids, as shown in FIG. 2. For this reason, drying in Comparative Example 5 required a very long time in comparison of Example 11. On the other hand, drying in Comparative Example 6 under the same drying conditions as used in Example 11caused the occurrence of many voids because of its drying temperature higher than 190° C. leading to a decrease in tensile strength.

Comparative Example 7

The polybenzoxazole fibers were prepared and dried in the same manner as described in Example 11, except that the drying conditions were changed. The physical properties of the fibers, together with the drying conditions, ate shown in Table 3 below.

If neutralization is carried out, the initial drying temperature is not higher than 220° C., which can be applied to the case where fibers with a residual moisture content of 38% after washing are to be dried without giving any voids, as shown in FIG. 2. For this reason, drying in this Comparative Example caused the occurrence of very many voids because of its drying temperature higher than 220$^{4}$° C., leading to a remarkable decrease in tensile strength.

TABLE 3

| | Ex. 11 | Comp. Ex. 5 | Comp. Ex. 6 | Comp. Ex. 7 |
|---|---|---|---|---|
| Neutralizing agent | NaOH | — | — | NaOH |
| Concentration of neutralizing agent (N) | 0.1 | — | — | 0.1 |
| Molar ratio of neutralizing agent to acid solvent in fiber | 1.2 | — | — | 1.2 |
| Spinning rate (m/min) | 400 | 400 | 400 | 400 |
| Concentration of residual acid solvent (ppm) | 4800 | 4600 | 4600 | 4700 |
| Residual moisture content before drying (%) | 38 | 38 | 38 | 38 |
| Heating means in first heating zone | heating rollers | heating rollers | heating rollers | heating rollers |
| Temperature of first heating zone (°C.) | 220 | 170 | 220 | 250 |

TABLE 3-continued

| | Ex. 11 | Comp. Ex. 5 | Comp. Ex. 6 | Comp. Ex. 7 |
|---|---|---|---|---|
| Residence time in first heating zone (sec) | 60 | 84.3 | 60 | 20 |
| Residual moisture content after first drying (%) | 9.5 | 18.0 | 9.5 | 16.2 |
| Heating means in second heating zone | heating rollers | heating rollers | heating rollers | heating rollers |
| Temperature of second heating zone (°C.) | 225 | 200 | 225 | 260 |
| Residence time in second heating zone (sec) | 34 | 84.3 | 34 | 20 |
| Residual moisture content after second drying (%) | 5.7 | 9 | 5.7 | 9.1 |
| Heating means in third heating zone | heating rollers | heating rollers | heating rollers | heating rollers |
| Temperature of third heating zone (°C.) | 255 | 240 | 255 | 300 |
| Residence time in third heating zone (sec) | 34 | 79.3 | 34 | 30 |
| Residual moisture content after third drying (%) | 1.6 | 1.5 | 1.6 | 1.6 |
| Total residence time in heating zones (sec) | 128 | 247.9 | 128 | 70 |
| Fineness (denier)/number of filaments | 250/166 | 250/166 | 250/166 | 250/166 |
| Tensile strength (g/d) | 43 | 39 | 37 | 36 |
| Breaking elongation (%) | 3.3 | 3.0 | 3.2 | 2.9 |
| Tensile modulus of elasticity (g/d) | 1619 | 1624 | 1610 | 1655 |
| Occurrence of voids | none | none | slight to many | very many |

Example 12

The polybenzoxazole fiber was prepared and dried in the same manner as described in Example 11. except that the concentration of a basic solution used in the neutralizing step was changed to 0.001N . The physical properties of the fiber. together with the drying conditions, are shown in Table 4 below.

As can be seen from Table 4, even if the concentration of a basic solution is changed, the fiber can be dried so as to have substantially the same residual moisture content as obtained in Example 11, so long as the conditions of drying temperature without giving any voids as shown in FIG. 2 are used. Furthermore, the change of neutralizing conditions has no significant influence on the physical properties of the fiber as well as the drying conditions.

Example 13

The polybenzoxazole fiber was prepared and dried in the same manner as described in Example 11, except the spinning rate was changed to 600 m/min. The physical properties of the fiber, together with the drying conditions, are shown in Table 4 below.

As can be seen from Table 4, even if the spinning rate is increased, the fiber can be rapidly dried without giving any voids.

TABLE 4

| | Example 12 | Example 13 |
|---|---|---|
| Neutralizing agent | NaOH | NaOH |
| Concentration of neutralizing agent (N) | 0.001 | 0.1 |
| Molar ratio of neutralizing agent to acid solvent in fiber | 1.15 | 1.2 |
| Spinning rate (m/min) | 400 | 600 |

TABLE 4-continued

| | Example 12 | Example 13 |
|---|---|---|
| Concentration of residual acid solvent (ppm) | 4650 | 7150 |
| Residual moisture content before drying (%) | 38 | 38 |
| Heating means in first heating zone | heating rollers | heating rollers |
| Temperature of first heating zone (°C.) | 220 | 220 |
| Residence time in first heating zone (sec) | 60 | 60 |
| Residual moisture content after first drying (%) | 9.7 | 9.9 |
| Heating means in second heating zone | heating rollers | heating rollers |
| Temperature of second heating zone (°C.) | 225 | 22 5 |
| Residence time in second heating zone (sec) | 34 | 34 |
| Residual moisture content after second drying (%) | 5.6 | 5.8 |
| Heating means of third heating zone | heating rollers | heating rollers |
| Temperature of third heating zone (°C.) | 255 | 255 |
| Residence time in third heating zone (sec) | 34 | 34 |
| Residual moisture content after third drying (%) | 1.5 | 1.6 |
| Total residence time in heating zones (sec) | 128 | 128 |
| Fineness (denier)/number of filaments | 250/166 | 250/166 |
| Tensile strength (g/d) | 43 | 44 |
| Breaking elongation (%) | 3.2 | 3.3 |
| Tensile modulus of elasticity (g/d) | 1621 | 1620 |
| Occurrence of voids | none | none |

Examples 14 and 15

The polybenzoxazole fiber was prepared and dried in the same manner as described in Example 11, except the heating means were changed to heating ovens (Example 14) and to overheated water vapor and heating rollers (Example 15). The physical properties of the fiber, together with the drying conditions, are shown in Table 5 below.

As can be seen from Table 5, even if drying is carried out by heating ovens or a combination of overheated water vapor and heating rollers, the fiber can be rapidly dried for the same drying time as taken in Example 11, so long as the conditions of drying temperature without giving any voids as shown in FIG. 2 are used. Furthermore, even if the heating means are changed, the drying conditions can be optimized by controlling the temperatures of the heating zones.

TABLE 5

| | Example 14 | Example 15 |
|---|---|---|
| Neutralizing agent | NaOH | NaOH |
| Concentration of neutralizing agent (N) | 0.1 | 0.1 |
| Molar ratio of neutralizing agent to acid solvent in fiber | 1.2 | 1.2 |
| Spinning rate (m/min) | 400 | 400 |
| Concentration of residual acid solvent (ppm) | 4750 | 4800 |
| Residual moisture content before drying (%) | 38 | 38 |
| Heating means in first heating zone | heating oven | overheated water vapor |
| Temperature of first heating zone (°C.) | 220 | 220 |
| Residence time in first heating zone (sec) | 60 | 60 |
| Residual moisture content after first drying (%) | 9.6 | 9.2 |
| Heating means in second heating zone | heating oven | heating rollers |
| Temperature of second heating zone (°C.) | 225 | 225 |
| Residence time in second heating zone (sec) | 34 | 34 |
| Residual moisture content after second drying (%) | 5.5 | 5.4 |
| Heating means of third heating zone | heating oven | heating rollers |

TABLE 5-continued

| | Example 14 | Example 15 |
|---|---|---|
| Temperature of third heating zone (°C.) | 255 | 255 |
| Residence time in third heating zone (sec) | 34 | 34 |
| Residual moisture content after third drying (%) | 1.6 | 1.5 |
| Total residence time in heating zones (sec) | 128 | 128 |
| Fineness (denier)/number of filaments | 250/166 | 250/166 |
| Tensile strength (g/d) | 43 | 44 |
| Breaking elongation (%) | 3.1 | 3.2 |
| Tensile modulus of elasticity (g/d) | 1634 | 1650 |
| Occurrence of voids | none | none |

As described above, the present invention makes it possible to produce high-performance polybenzazole fibers at a low cost on an industrial scale with a quite compact equipment by high-speed drying for a remarkably shortened period of time as compared with the conventional process.

What is claimed is:

1. A process for producing a polybenzazole fiber, comprising the steps of: extruding a spinning dope containing a polybenzazole polymer in an acid solvent through a spinning to form a dope filament; coagulating the dope filament as a fiber in a coagulating medium; washing the fiber with a fluid capable of dissolving the acid solvent; and drying the fiber, in a heating zone with at least 80% part of the total length of the heating zone being set at 240° C. or higher.

2. A process according to claim 1, wherein the coagulating medium is an aqueous solution of polyphosphoric acid at a concentration of from 6% to less than 50% and has a temperature of from 30° C. to 120° C.

3. A process according to claim 1, wherein the fiber after the washing step is dried so as to have a residual moisture content of less than 2% within 80 seconds.

4. A process according to claim 1, wherein the fiber after the washing step is predried at 180° C. under a tension of 2 g/d so as to have a residual moisture content of about 25% and to exhibit a single peak for liquid freezing in the fiber over a temperature range of from 20° to −70° C. when measured by differential scanning calorimetry (DSC), and the resulting polybenzazole intermediate predried fiber is subjected to the drying step.

5. A process for producing a polybenzazole fiber, comprising the steps of: extruding a spinning dope containing a polybenzazole polymer in an acid solvent through a spinning noz7le to form a dope filament; coagulating the dope filament as a fiber in a coagulating medium; washing the fiber with a fluid capable of dissolving the acid solvent; bringing the fiber into contact with a basic solution for neutralization; washing the fiber with a fluid capable of dissolving the basic solution; and drying the fiber at a temperature set depending upon the residual moisture content in the fiber.

6. A process according to claim 5, wherein the initial drying temperature is set at 190° C. or higher.

7. A process according to claim 5, wherein the initial drying temperature is set in the range of from 190° to 220° C. when the fiber to be subjected to the drying step has a residual moisture content of 25% or higher.

8. A process according to claim 5, wherein the fiber after the second washing step is dried so as to have a residual moisture content of 6% or lower.

9. A process according to claim 5, wherein the drying time is 3 minutes or shorter.

* * * * *